US010370735B2

(12) United States Patent
Matsuda et al.

(10) Patent No.: US 10,370,735 B2
(45) Date of Patent: Aug. 6, 2019

(54) HEAT TREATED STEEL PRODUCT HAVING HIGH STRENGTH AND EXCELLENT CHEMICAL CONVERSION COATING ABILITY AND METHOD OF PRODUCTION OF SAME

(71) Applicant: NIPPON STEEL & SUMITOMO METAL CORPORATION, Tokyo (JP)

(72) Inventors: Hideki Matsuda, Tokyo (JP); Koji Akioka, Tokyo (JP); Kazuo Uematsu, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 67 days.

(21) Appl. No.: 15/517,720

(22) PCT Filed: Oct. 5, 2015

(86) PCT No.: PCT/JP2015/078225

§ 371 (c)(1),
(2) Date: Apr. 7, 2017

(87) PCT Pub. No.: WO2016/056514

PCT Pub. Date: Apr. 14, 2016

(65) Prior Publication Data

US 2017/0292171 A1 Oct. 12, 2017

(30) Foreign Application Priority Data

Oct. 8, 2014 (JP) ..... 2014-207597

(51) Int. Cl.
*B21C 37/00* (2006.01)
*C21D 9/08* (2006.01)
(Continued)

(52) U.S. Cl.
CPC ..... *C21D 9/085* (2013.01); *B21B 1/22* (2013.01); *B21D 7/16* (2013.01); *C21D 1/18* (2013.01);
(Continued)

(58) Field of Classification Search
None
See application file for complete search history.

(56) References Cited

U.S. PATENT DOCUMENTS 4,050,043 A 9/1977 Reuting et al.
5,669,992 A 9/1997 Bronsema et al.
(Continued)

FOREIGN PATENT DOCUMENTS

CN 102658301 * 9/2012 ..... B21B 45/00
JP 50-97568 A 8/1975
(Continued)

OTHER PUBLICATIONS

International Search Report for PCT/JP2015/078225 dated Dec. 15, 2015.
(Continued)

*Primary Examiner* — Seth Dumbris
(74) *Attorney, Agent, or Firm* — Birch, Stewart, Kolasch & Birch, LLP

(57) ABSTRACT

A steel product bent by heating to 600° C. or more, specifically a heat treated steel product having high strength and excellent chemical conversion coating ability which has scale with FeO content of 90% or more, having a thickness of 1 μm or less on the surface.

4 Claims, 1 Drawing Sheet

(51) Int. Cl.

| | |
|---|---|
| ***B21D 7/16*** | (2006.01) |
| ***C21D 1/74*** | (2006.01) |
| ***C21D 1/18*** | (2006.01) |
| ***C22C 38/00*** | (2006.01) |
| ***C22C 38/32*** | (2006.01) |
| ***B21B 1/22*** | (2006.01) |
| ***C22C 38/02*** | (2006.01) |
| ***C22C 38/04*** | (2006.01) |
| ***C22C 38/06*** | (2006.01) |
| ***C22C 38/26*** | (2006.01) |
| ***C22C 38/28*** | (2006.01) |
| *C23C 22/12* | (2006.01) |

(52) U.S. Cl.

CPC ..... *C21D 1/74* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/26* (2013.01); *C22C 38/28* (2013.01); *C22C 38/32* (2013.01); *B21B 2001/225* (2013.01); *C21D 2211/008* (2013.01); *C21D 2241/00* (2013.01); *C23C 22/12* (2013.01)

(56) References Cited

U.S. PATENT DOCUMENTS

| | | | | |
|---|---|---|---|---|
| 6,210,806 | B1 * | 4/2001 | Hidaka | C21D 6/002 428/469 |
| 6,383,297 | B1 * | 5/2002 | Schmidt | C21D 1/78 110/188 |
| 7,229,506 | B2 * | 6/2007 | Giordani | C23G 1/086 134/2 |
| 8,092,916 | B2 * | 1/2012 | Takeda | C21D 1/74 428/328 |
| 2008/0066517 | A1 | 3/2008 | Tomizawa et al. | |
| 2009/0199612 | A1 | 8/2009 | Takahashi et al. | |
| 2016/0017448 | A1 | 1/2016 | Masumoto | |

FOREIGN PATENT DOCUMENTS

| | | | | |
|---|---|---|---|---|
| JP | 61-182825 | A | 8/1986 | |
| JP | 6-100945 | A | 4/1994 | |
| JP | 2003171739 | * | 6/2003 | C22C 38/00 |
| JP | 6-100945 | A | 4/2007 | |
| JP | 2007-83304 | A | 4/2007 | |
| JP | 2011-89150 | A | 5/2011 | |
| JP | 2012-246515 | A | 12/2012 | |
| WO | WO 2006/093006 | A1 | 9/2006 | |
| WO | WO 2008/007737 | A1 | 1/2008 | |
| WO | WO 2014/157203 | A1 | 10/2014 | |

OTHER PUBLICATIONS

Written Opinion of the International Searching Authority for PCT/JP2015/078225 (PCT/ISA/237) dated Dec. 15, 2015.

* cited by examiner

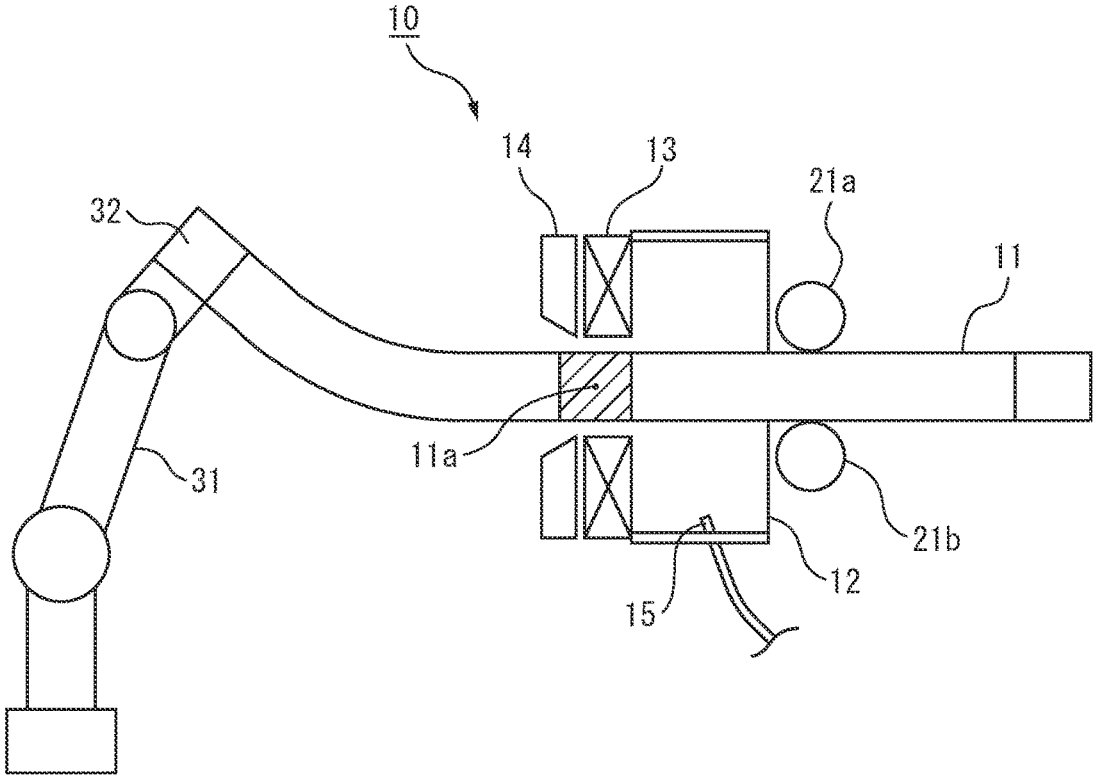
10
14
13
21a
32
11
11a
31
21b
12
15

HEAT TREATED STEEL PRODUCT HAVING HIGH STRENGTH AND EXCELLENT CHEMICAL CONVERSION COATING ABILITY AND METHOD OF PRODUCTION OF SAME

TECHNICAL FIELD

The present invention relates to a heat treated steel product excellent in chemical conversion coating ability for priming a coating surface and excellent in corrosion resistance after coating even after heat treatment without going through a special step for removal of oxidation scale and to a method of production of the same.

BACKGROUND ART

In recent years, from the viewpoint of global environmental issues and crash safety performance, thinner and higher strength structural parts have been sought for automobiles. To meet with these demands, structural parts for automobiles made using high strength steel sheet as materials have been increasing. However, if using high strength steel sheet as the material for press-forming operations to produce structural parts for automobiles, defects such as wrinkles and springback will easily occur in the shaped products. Therefore, it is not easy to use high strength steel sheet as the material for press-forming operations to produce structural parts for automobiles.

As the means for solving such a problem, the technique of hot working the steel material and rapidly cooling it for hardening so as to produce a high strength part has been commercialized. For example, hot pressing works steel sheet at a high temperature where it is soft and high in ductility, so can form complicated shapes with good dimensional precision. Furthermore, by heating steel sheet to the austenite region and rapidly cooling it in a die, it is possible to simultaneously achieve higher strength of the steel sheet through martensite transformation.

However, with such a working method, the steel is heated to a high temperature of 800 to 1000° C., so the problem arises that the surface of the steel sheet oxidizes. If such scale remains, when coating the surface at the next step, the adhesion between the steel sheet and the coating film will become inferior and a drop in the corrosion resistance will be invited. Therefore, after the press-forming, shot blasting or other treatment for scale removal is necessary.

PLT 1 discloses the technique of bending of a metal material during which making a heating device and cooling device move relative to the metal material while using the heating device to locally heat the metal material, giving a bending moment to the portion greatly falling in deformation resistance due to the heating to bend the material to a desired shape bent two-dimensionally or three-dimensionally, and next using the cooling device to cool the material to harden it (below, referred to as "hot 3D bending").

Hot 3D bending is a working technique used mainly for automobile members. It was developed as a technique for simultaneously meeting the two contradictory needs of lighter weight of the car body and improved crash safety. Hot bending locally heats a steel tube while hardening it by water cooling and simultaneously gives a bending moment to bend the tube and thereby enables production of a complicatedly shaped closed cross-section structural member by a single process. Shaping an auto part in cross-sectional structure at over 1470 MPa becomes possible.

However, this method also heats the steel material to the austenite region and rapidly cools it by a cooling medium so as to try to raise the strength of the steel material by martensite transformation, so there are the problems that oxidation scale forms on the surface, the adhesion of the steel material and coating film becomes inferior when coating the surface in the next step, and a drop in corrosion resistance is invited.

To deal with these problems, the inventors disclosed by PLT 2 an invention relating to a method of production and production apparatus of hardened steel material conveying steel material in its longitudinal direction while heating the conveyed steel material to the hardenable temperature region, then cooling to harden the steel material to thereby suppress or eliminate the formation of oxidation scale.

According to this invention, the steel material is conveyed in its longitudinal direction while using a heating device arranged at a first position separated from the conveyed steel material so as to heat the steel material to the hardenable temperature region and using a cooling device arranged at a second position downstream from the first position in the direction of conveyance of the steel material to spray the steel material with a cooling medium and thereby harden the steel material. During this, at the steel material, an inert gas or reducible gas is filled in the space around the heated part from the heating device so as to produce a hardened steel material suppressed in oxidation scale.

CITATION LIST

Patent Literature

PLT 1: Japanese Patent Publication No. 2007-83304A
PLT 2: Japanese Patent Publication No. 2011-89150A

SUMMARY OF INVENTION

Technical Problem

The inventors engaged in intensive studies to further improve the invention disclosed by PLT 2. As a result, the inventors discovered that even if using a heating device to blow and fill an inert gas into a space around the part where the steel material is heated, it is extremely difficult to completely eliminate oxidation scale and scale (oxidation film) is unavoidably formed and that, depending on the heating and cooling conditions, due to that unavoidable scale, sometimes the chemical conversion coating ability is inferior.

If scale is thick, it easily peels off and therefore the steel material is impaired in chemical conversion coating ability and electrodeposition coating ability after being worked. Further, if the scale is uneven in thickness, the chemical conversion coating or electrodeposition coating becomes uneven. However, providing an oxidation scale removal step to remove the oxidation scale after working leads to a rise in cost, so this is not preferable.

The present invention was made in consideration of this new problem and has as its object the provision of a heat treated steel product excellent in chemical conversion coating ability for priming a coating surface and excellent in corrosion resistance after coating even after heat treatment without going through a special step for removal of oxidation scale and the provision of a method of production of the same. Furthermore, specifically, it has as its object the provision of a heat treated steel product which is produced by heat treating or bending with heat treatment an unplated steel material and which has high strength and excellent chemical conversion coating ability and corrosion resistance after coating, so for example, can be suitably used as an automobile member and the provision of a method of production of the same.

Solution to Problem

The inventors investigated in what cases the chemical conversion coating ability deteriorates and as a result learned that by heating in an atmosphere in which an inert gas is blown, even if a small amount of scale is formed, if the scale dissolves and iron ions are supplied at the time of formation of the chemical conversion coating or if the base material dissolves and iron ions are supplied, a sound chemical conversion coating is formed and that, on the other hand, if the formed scale does not sufficiently dissolve at the time of formation of the chemical conversion coating, the chemical conversion coating ability will be inferior.

The inventors engaged in further intensive studies and as a result learned that if the scale has a thickness of 1 μm or less and the FeO contained in the scale is 90% or more, Fe ions are sufficiently supplied at the time of formation of the chemical conversion coating and a good chemical conversion coating becomes possible. Further, they learned that for realizing such scale, it is sufficient to use a working apparatus having a gas chamber, heating device, and cooling device and perform 3D bending while running the inert gas and during that time making the time period during which the steel material dwells in a 600° C. or more temperature region less than 1 second. The present invention was made based on this discovery and has as its gist the following:

(1) Heat treated steel product having high strength and excellent chemical conversion coating ability comprising a scale with FeO content of 90% or more, having a thickness of 1 μm or less on the surface.

(2) The heat treated steel product having high strength and excellent chemical conversion coating ability according to (1), wherein the steel has a structure consisting of martensite, or martensite and tempered martensite.

(3) The heat treated steel product according to (1) or (2), wherein the steel product is a hollow member having a closed horizontal cross-sectional shape.

(4) The heat treated steel product according to any one of (1) to (3), wherein a maximum value and a minimum value of the thickness of the scale are within ±10% of an average value of the thickness.

(5) A method of producing a heat treated steel product using a working apparatus having a gas chamber, a heating device, and a cooling device from an upstream side, the method of producing the heat treated steel product comprising introducing an inert gas into a gas chamber and filling the inert gas into a space including the heating device and the cooling device while making the working apparatus move relative to a steel material so that the steel material is locally heated by the heating device then the steel material is cooled by the cooling device, wherein a time period during which the steel material dwells in a 600° C. or more temperature region is less than 1 second and between the heating and cooling, a bending operation is performed at a portion of the steel material greatly dropping in deformation resistance due to heating.

(6) The method of producing a heat treated steel product according to (5) wherein in the step of cooling, a time period during which the steel material dwells in a 600° C. to 300° C. temperature region is within 3 seconds.

Advantageous Effects of Invention

According to the present invention, at the time of chemical conversion, the scale is dissolved and a sound chemical converted film is formed, so a heat treated steel product is provided which is excellent in chemical conversion coating ability and in turn excellent in corrosion resistance after coating as well even if supplied to the chemical conversion coating and other coating steps without going through a shot blasting or other scale removal step and therefore is suitable for use for applications in which a certain degree of corrosion resistance is necessary even if heavy corrosion resistance of an extent requiring sacrificial protection by plating is not sought.

As a portion for application of the heat treated steel product according to the present invention, in the case of an auto part, making the strength higher enables the vehicle to be made lighter in weight. A portion where corrosion resistance is demanded is preferable. For example, a pillar, door beam, roof, bumper, or other reinforcements, frames, arms, etc. may be mentioned.

BRIEF DESCRIPTION OF DRAWINGS

FIG. 1 is a view showing one example of a working apparatus able to be used in the present invention.

DESCRIPTION OF EMBODIMENTS

The reasons for limitation of the heat treatment use product and the method of production of the same according to the present invention will be explained below.

The heat treated steel product of the present invention is produced using as a material a steel material which has not been plated. The surface of the product after heat treatment has a very thin scale (oxide film). The thickness has to be 1 μm or less.

If the thickness of the scale exceeds 1 μm, a lot of scale will remain without being dissolved at the time of chemical conversion, the supply of iron ions will become insufficient, and the chemical conversion coating ability will become degraded. Further, if the scale becomes thicker, even if a chemical conversion coating is formed on the scale, the scale and base iron will easily peel apart and the coating adhesion will become inferior. Therefore, the thickness of the scale is 1 μm or less, preferably 0.5 μm or less.

Further, scale has to include FeO: 90% or more. This ratio can be found by finding the X-ray intensities of FeO, $Fe_3O_4$, and $Fe_2O_3$ by analyzing the product surfaces by X-ray diffraction and calculating the ratio of the X-ray intensity of FeO with respect to the total of the X-ray intensities of FeO, $Fe_3O_4$, and $Fe_2O_3$.

If the ratio of FeO is less than 90%, a lot of scale will remain without dissolving at the time of chemical conversion, the supply of iron ions will become insufficient, and the chemical conversion coating ability will become inferior. The reason is not necessary clear, but is believed to be like the following:

In scale, first, FeO is formed at a high temperature. Along with the progression of oxidation, $Fe_3O_4$ is formed or, during the cooling process, some of the FeO undergoes eutectoid transformation and $Fe_3O_4$ is formed. If, in the product, the ratio of FeO in the scale decreases and the ratio of $Fe_3O_4$ increases, the chemical conversion coating ability deteriorates since $Fe_3O_4$ is harder to dissolve in a chemical conversion coating solution compared with FeO.

The steel product of the present invention has to have the high strength obtained by heat treatment while being excellent in chemical conversion coating ability, so the steel structure is comprised of martensite. However, depending on the required strength and performance, part of the martensite may also be replaced with tempered martensite. Further, carbides and residual austenite which unavoidably remain in the process of heat treatment may also be contained.

Note that, the steel is not limited in structure in the non-heat treated parts provided anywhere in a heat treated steel product as needed and the boundary region between a heat treated part and non-heat treated part. Such a part may be provided at part of the product.

The heat treated steel product of the present invention is not particularly limited in shape, but a hollow member having a closed horizontal cross-sectional shape is suitable. A heat treated steel product can be produced for example by hot 3D bending. Hot 3D bending is suitable for obtaining a high strength, high rigidity hollow member having any bent shape.

The heat treated steel product of the present invention is produced using a working apparatus having a gas chamber, heating device, and cooling device from the upstream side. Below, this will be explained more specifically using FIG. 1.

FIG. 1 shows one example of the working apparatus used in the present invention. The steel material 11 is made to move with respect to the working apparatus 10 to work it. The working apparatus has a gas chamber 12, heating device 13, and cooling device 14 from the upstream side. In FIG. 1, for assisting understanding of the structure, the cross-section is drawn, but the gas chamber 12, heating device 13, and cooling device 14 are provided so as to cover the entire circumference of the steel material 11.

Inside the gas chamber 12, argon, nitrogen, or another inert gas is introduced. The inert gas is filled in the space containing the heating device 13 and cooling device 14. The steel material 11 is heated locally by the heating device 13 (11*a*), then is cooled by the cooling device 14. Here, in the process of heating and cooling, the time period during which the steel material 11 dwells in the 600° C. or more temperature region is made less than 1 second.

If performing the heat treatment in the state where air is contained in the space around the heated part of the steel material, thick scale is formed and the chemical conversion coating ability and corrosion resistance after coating deteriorate. On the other hand, even if blowing and filling the inert gas in the space around the heated part, if the dwell time in the 600° C. or higher temperature region where the steel material rapidly oxidizes exceeds 1 second, the scale is formed thickly or the scale advances in degree of oxidation and the ratio of $Fe_3O_4$ increases, so the chemical conversion coating ability deteriorates.

Therefore, in the present invention, a working apparatus provided with a gas chamber at an upstream side of a heating device is used, the inert gas is introduced into the gas chamber, and the space around the heated part and cooled part of the steel material including the space around the steel material before heating is filled with the inert gas. Furthermore, in the heating and cooling process, the time period during which the steel material dwells at 600° C. or more is made less than 1 second, preferably is made 0.5 second or less.

Furthermore, in the process where the steel material is cooled, the time period during which the steel material dwells at 600° C. to 300° C. in temperature region is preferably made within 3 seconds. If scale is formed at a high temperature, then becomes near 600° C. or less in the cooling process, the FeO undergoes eutectoid transformation and $Fe_3O_4$ is formed. For this reason, making the steel material quickly pass through the 600° C. to 300° C. temperature region where the reaction easily proceeds so as to suppress the formation of $Fe_3O_4$ and return the steel material to a low temperature with the FeO as is preferable for obtaining an excellent chemical conversion coating ability.

Furthermore, in the present invention, by sufficiently filling the inert gas around the heated part of the steel material, it becomes possible to make the thickness of the scale uniform. Preferably, the maximum value and minimum value of thickness of the scale can be made ±10% or less of the average value of the thickness.

It is also possible add tempering or other heat treatment in accordance with the strength and performance required from the product. In this case, it is effective to make the dwell time at 600° C. or more through all of the heat treatment less than 1 second, more preferably make the dwell time from 600° C. to 300° C. less than 3 seconds.

Note that, the positioning devices 21*a*, 22*b*, industrial robot 32, chuck 33, etc. drawn in FIG. 1 show preferable examples of a working apparatus able to be used in the present invention. The present invention is not limited by this drawing needless to say. Further, while not shown, it is also possible to provide a shield plate at the downstream side of the cooling device 14 to make it easier for the inert gas to fill the space including the gas chamber 12, heating device 13, and cooling device 14.

EXAMPLES

To confirm the effects of the present invention, rectangular cross-section electric resistance welded steel tubes having the chemical composition shown in Table 1 (40 mm×40 mm×thickness 1.6 mm) as materials were prepared.

TABLE 1

| (mass %, balance: Fe and unavoidable impurities) | | | | | | | | | | |
|---|---|---|---|---|---|---|---|---|---|---|
| C | Si | Mn | P | S | sol. Al | N | Cr | Ti | Nb | B |
| 0.22 | 0.20 | 0.75 | 0.014 | 0.003 | 0.04 | 0.004 | 0.30 | 0.030 | 0.025 | 0.015 |

These steel tube materials were heat treated under the conditions shown in Table 2 using the hot 3D bending apparatus shown in FIG. 1 to obtain heat treated steel products. Note that, No. 3 of Table 2 was tempered by control of the cooling process of the hot 3D bending apparatus.

The obtained heat treated steel products were examined for cross-sectional structure after Nital etching using a scanning electron microscope at powers of 500× for four fields to confirm the steel structure.

judged as "good". In the evaluation of rust and blistering of the JASO test, samples with a maximum width of rust or blistering at the two sides of the cuts of 12 mm or less were judged as "good".

The results are shown together in Table 2. Note that, in the column of "Steel structure" of Table 2, "M" indicates martensite, while "TM" indicates tempered martensite. In the results of evaluation of the corrosion resistance after coating, good is indicated by "G", while poor is indicated by "P".

TABLE 2

| | Production conditions | | | | | | | Corrosion resistance after coating | | |
|---|---|---|---|---|---|---|---|---|---|---|
| | | | | | | Scale | | | | |
| No. | Heated part atmosphere | Heating temp. (° C.) | Dwell time at 600° C. or more (sec) | Dwell time at 600 to 300° C. (sec) | Steel structure | Thickness (μm) | FeO ratio (%) | Coating adhesion test | JASO test | Class |
| 1 | Blown | 1000 | 0.4 | 1 | M | 0.3 | 98 | G | G | Inv. ex. |
| 2 | nitrogen | 1000 | 0.9 | 1 | M | 0.8 | 90 | G | G | Inv. ex. |
| 3 | | 1000 | 0.4 | 2.8 | M+ partial TM | 0.4 | 92 | G | G | Inv. ex. |
| 4 | | 1000 | 2.0 | 1 | M | 1.5 | 85 | G | P | Comp. ex. |
| 5 | | 1000 | 1.0 | 10 | M | 1.0 | 80 | G | P | Comp. ex. |
| 6 | Air | 1000 | 0.4 | 1 | M | 3.0 | 70 | P | P | Comp. ex. |

Further, the surfaces of the steel tubes were measured for thickness of the scale by X-ray photoelectron spectrometry. X-ray diffraction was used for analysis of the scale composition. The X-ray intensities of the FeO, $Fe_3O_4$, and $Fe_2O_3$ were found and the ratio of the X-ray intensity of FeO with respect to the total of the X-ray intensities of the FeO, $Fe_3O_4$, and $Fe_2O_3$ was calculated. This was used as the FeO ratio in the scale.

Here, the ratio of the X-ray intensity evaluates the X-ray diffraction peaks of FeO, $Fe_3O_4$, and $Fe_2O_3$ at the time of an X-ray source of CuKα (40 kV-50 mA) by the Rietveld method.

Further, the obtained heat treated steel products were formed with similar chemical conversion coatings as above, then were formed with electrodeposition coatings by a PN-110 made by Nippon Paint aiming at a coating thickness of 20 μm to obtained coated products. The coated products were evaluated for cross-cut tape peeling after immersion in 40° C. warm water for 240 hours as a coating film adhesion test. Further, they were evaluated for rust and blistering of the cut parts after 180 cycles of a JASO cyclic corrosion test.

In the coating film adhesion test, samples where there were no greatly peeling pieces and where small peeling of the cut cross parts accounted for 5 area % or less were As shown in Table 2, it could be confirmed that by satisfying the ranges prescribed in the present invention, a heat treated steel product excellent in chemical conversion coating ability and in turn excellent also in corrosion resistance after coating is provided even if used for a chemical conversion coating step without going through a shot blasting or other scale removal step.

The invention claimed is:

1. Heat A heat treated steel product comprising a scale with FeO content of 90% or more, having a thickness of 1 μm or less on a surface, wherein a maximum value and a minimum value of a thickness of the scale are within ±10% of an average value of the thickness.

2. The heat treated steel product according to claim 1, wherein the steel has a structure consisting of martensite, or martensite and tempered martensite.

3. The heat treated steel product according to claim 1, wherein the steel product is a hollow member having a closed horizontal cross-sectional shape.

4. The heat treated steel product according to claim 2, wherein the steel product is a hollow member having a closed horizontal cross-sectional shape.

* * * * *